US011725380B2

(12) United States Patent
Marlow

(10) Patent No.: US 11,725,380 B2
(45) Date of Patent: Aug. 15, 2023

(54) STRUCTURAL SUPPORT APPARATUS, SYSTEM, AND METHOD

(71) Applicant: Woodstone Structures LLC, Springfield, OR (US)

(72) Inventor: Bryan Ray Marlow, Springfield, OR (US)

(73) Assignee: WOODSTONE STRUCTURES LLC, Springfield, OR (US)

( * ) Notice: Subject to any disclaimer, the term of this patent is extended or adjusted under 35 U.S.C. 154(b) by 8 days.

(21) Appl. No.: 17/352,209

(22) Filed: Jun. 18, 2021

(65) Prior Publication Data

US 2021/0310237 A1 Oct. 7, 2021

Related U.S. Application Data

(63) Continuation of application No. 16/892,176, filed on Jun. 3, 2020, now Pat. No. 11,041,303, which is a continuation of application No. PCT/US2018/063998, filed on Dec. 5, 2018.

(60) Provisional application No. 62/594,979, filed on Dec. 5, 2017.

(51) Int. Cl.

| | |
|---|---|
| ***E04B 1/41*** | (2006.01) |
| ***E04B 1/00*** | (2006.01) |
| ***E04B 1/26*** | (2006.01) |

(52) U.S. Cl.

CPC ..... *E04B 1/40* (2013.01); *E04B 1/0046* (2013.01); *E04B 1/2604* (2013.01); *E04B 2001/2616* (2013.01); *E04B 2001/2644* (2013.01); *E04B 2001/2648* (2013.01)

(58) Field of Classification Search

CPC .. E04B 1/40; E04B 1/2604; E04B 2001/2616; E04B 2001/2644; E04B 2001/2648; E04B 7/045; E04B 1/2612; E04B 2001/405; E04B 1/0046; Y10T 403/4605; E04H 6/025

See application file for complete search history.

(56) References Cited

U.S. PATENT DOCUMENTS

| | | | | |
|---|---|---|---|---|
| 1,787,167 | A * | 12/1930 | Purdy | E04B 1/2604 16/249 |
| 6,357,712 | B1 * | 3/2002 | Lu | F16M 11/10 248/185.1 |
| 7,798,461 | B2 * | 9/2010 | Hackney | E04B 7/045 248/397 |
| 7,918,054 | B2 * | 4/2011 | Grafton | E04B 7/02 248/300 |
| 10,465,389 | B2 * | 11/2019 | Hughes | E04F 10/08 |
| 11,149,431 | B1 * | 10/2021 | Meznarich | E04B 1/40 |
| 2007/0292204 | A1 * | 12/2007 | Hackney | E04B 1/10 403/93 |
| 2008/0277551 | A1 * | 11/2008 | Hackney | E04B 1/2604 248/276.1 |
| 2009/0211177 | A1 * | 8/2009 | Grafton | E04D 3/3608 248/237 |

* cited by examiner

*Primary Examiner* — Brent W Herring

(74) *Attorney, Agent, or Firm* — Alleman Hall Creasman & Tuttle LLP

(57) ABSTRACT

Structural support apparatus, system, and installation method, comprising a base member adapted for being mounted to an existing building structure, an attachment bracket mounted to the base member at a pivot point adapted to be set securely to an angle selected during installation, the attachment bracket also adapted for mounting to a wood riser having openings therein to match the attachment bracket.

20 Claims, 8 Drawing Sheets

| | | | | | | | | | | | | | |
|---|---|---|---|---|---|---|---|---|---|---|---|---|---|
| 1 | | 0 | 30 | 60 | 90 | 120 | 150 | 180 | 210 | 240 | 270 | 300 | 330 |
| 2 | | 6 | 36 | 66 | 96 | 126 | 156 | 186 | 216 | 246 | 276 | 306 | 336 |
| 3 | | 12 | 42 | 72 | 102 | 132 | 162 | 192 | 222 | 252 | 282 | 312 | 342 |
| 4 | | 18 | 48 | 78 | 108 | 138 | 168 | 198 | 228 | 258 | 288 | 318 | 348 |
| 5 | | 24 | 54 | 84 | 114 | 144 | 174 | 204 | 234 | 264 | 294 | 324 | 354 |
| 6 | | 30 | 60 | 90 | 120 | 150 | 180 | 210 | 240 | 270 | 300 | 330 | 360 |
| 7 | | 36 | 66 | 96 | 126 | 156 | 186 | 216 | 246 | 276 | 306 | 336 | 6 |
| 8 | | 42 | 72 | 102 | 132 | 162 | 192 | 222 | 252 | 282 | 312 | 342 | 12 |
| 9 | | 48 | 78 | 108 | 138 | 168 | 198 | 228 | 258 | 288 | 318 | 348 | 18 |
| 10 | | 54 | 84 | 114 | 144 | 174 | 204 | 234 | 264 | 294 | 324 | 354 | 24 |
| 11 | | 60 | 90 | 120 | 150 | 180 | 210 | 240 | 270 | 300 | 330 | 360 | 30 |
| 12 | | 66 | 96 | 126 | 156 | 186 | 216 | 246 | 276 | 306 | 336 | 6 | 36 |
| 13 | | 72 | 102 | 132 | 162 | 192 | 222 | 252 | 282 | 312 | 342 | 12 | 42 |
| 14 | | 78 | 108 | 138 | 168 | 198 | 228 | 258 | 288 | 318 | 348 | 18 | 48 |
| 15 | | 84 | 114 | 144 | 174 | 204 | 234 | 264 | 294 | 324 | 354 | 24 | 54 |
| 16 | | 90 | 120 | 150 | 180 | 210 | 240 | 270 | 300 | 330 | 360 | 30 | 60 |
| 17 | | 96 | 126 | 156 | 186 | 216 | 246 | 276 | 306 | 336 | 6 | 36 | 66 |
| 18 | | 102 | 132 | 162 | 192 | 222 | 252 | 282 | 312 | 342 | 12 | 42 | 72 |
| 19 | | 108 | 138 | 168 | 198 | 228 | 258 | 288 | 318 | 348 | 18 | 48 | 78 |
| 20 | | 114 | 144 | 174 | 204 | 234 | 264 | 294 | 324 | 354 | 24 | 54 | 84 |
| 21 | | 120 | 150 | 180 | 210 | 240 | 270 | 300 | 330 | 360 | 30 | 60 | 90 |
| 22 | | 126 | 156 | 186 | 216 | 246 | 276 | 306 | 336 | 6 | 36 | 66 | 96 |
| 23 | | 132 | 162 | 192 | 222 | 252 | 282 | 312 | 342 | 12 | 42 | 72 | 102 |
| 24 | | 138 | 168 | 198 | 228 | 258 | 288 | 318 | 348 | 18 | 48 | 78 | 108 |
| 25 | | 144 | 174 | 204 | 234 | 264 | 294 | 324 | 354 | 24 | 54 | 84 | 114 |
| 26 | | 150 | 180 | 210 | 240 | 270 | 300 | 330 | 360 | 30 | 60 | 90 | 120 |
| 27 | | 156 | 186 | 216 | 246 | 276 | 306 | 336 | 6 | 36 | 66 | 96 | 126 |
| 28 | | 162 | 192 | 222 | 252 | 282 | 312 | 342 | 12 | 42 | 72 | 102 | 132 |
| 29 | | 168 | 198 | 228 | 258 | 288 | 318 | 348 | 18 | 48 | 78 | 108 | 138 |
| 30 | | 174 | 204 | 234 | 264 | 294 | 324 | 354 | 24 | 54 | 84 | 114 | 144 |
| 31 | | 180 | 210 | 240 | 270 | 300 | 330 | 360 | 30 | 60 | 90 | 120 | 150 |
| 1 | 0 | 1 | | | | | | 31 | 26 | 21 | 16 | 11 | 6 |
| 2 | 36 | 7 | 2 | | | | | | | 27 | 22 | 17 | 12 |
| 3 | 72 | 13 | 8 | 3 | | | | | | | 28 | 23 | 18 |
| 4 | 108 | 19 | 14 | 9 | 4 | | | | | | | 29 | 24 |
| 5 | 144 | 25 | 20 | 15 | 10 | 5 | | | | | | | 30 |
| 6 | 180 | 31 | 26 | 21 | 16 | 11 | 6 | 1 | | | | | |
| 7 | 216 | | | 27 | 22 | 17 | 12 | 7 | 2 | | | | |
| 8 | 252 | | | | 28 | 23 | 18 | 13 | 8 | 3 | | | |
| 9 | 288 | | | | | 29 | 24 | 19 | 14 | 9 | 4 | | |
| 10 | 324 | | | | | | 30 | 25 | 20 | 15 | 10 | 5 | |
| | | 1 | 2 | 3 | 4 | 5 | 6 | 7 | 8 | 9 | 10 | 11 | 12 |

FIG. 7

STRUCTURAL SUPPORT APPARATUS, SYSTEM, AND METHOD

CROSS-REFERENCE TO RELATED APPLICATIONS

This application is a continuation of U.S. patent application Ser. No. 16/892,176 entitled "Structural Support Apparatus, System, and Method" filed Jun. 3, 2020, in the name of Bryan Ray Marlow, which in turn is a continuation of International Application No. PCT/US2018/063998 entitled "Structural Support Apparatus, System, and Method" filed Dec. 5, 2018, in the name of Bryan Ray Marlow, which in turn claims benefit of U.S. Provisional App. No. 62/594,979 entitled "Patio Roof Riser" filed Dec. 5, 2017, in the name of Bryan Marlow, each of which are hereby incorporated by reference as if fully set forth herein.

TECHNICAL FIELD

The present invention relates to improvements in mounting apparatus adapted for attaching structural members to existing buildings, and more particularly to a fixable-hinged, pivotable-during-installation, variable-angle mounting apparatus, system, and installation method for easy installation attachment of sturdy and attractive structural elements to an existing structure to support another structure, such as a patio roof, an eyebrow-type support structure, or an angled handrailing, installed on and extending adjacent an existing roof.

BACKGROUND ART

When adding a structure to a building, such as a patio roof to cover a patio or deck located adjacent an existing building where part of the patio roof extends from and is partially supported by the existing building, an eyebrow-type support structure on a building, an angled handrailing extending from a building, or another support structure added to a building, many contractors have attached a portion of the added structure to a roof, or side surface, of the existing building. In some cases, added patio roof coverings attached directly to a roof, or fascia, without any structural elements, such as extensions or risers, have resulted in a somewhat non-elevated patio cover relative to a gutter or facia board adjacent the patio.

Such non-elevated patio roof covers have resulted in limited headroom and restricted airflow under the patio roof covers. Adding structural elements to raise patio roofs above the existing roofs of existing associated buildings has allowed for increased headroom and better airflow. The raising of patio roofs with risers has also allowed steeper slopes for the patio roofs, facilitating runoff of rain and snow, and minimizing the accumulation of debris.

Prior art for attaching an elevated patio roof has consisted of metal posts that have been designed to attach directly to the structural members of the building below the roof, and have extended through the existing building roof Installation of these prior posts has been labor-intensive, and has involved cutting into and modifying the existing building roof, sometimes over the building's occupied space envelope, which has required additional time and labor costs and increased liability for future leaks. Alternative deck roof, or patio roof, installations have required support posts in undesirable locations, which have often obstructed windows and entryways and have reduced usable deck or patio space.

In addition, the prior art has used metal posts that have not blended well with the visual design of patio roofs where wood has been the principal structural element and where the finished appearance has been of high importance to the customer. These metal posts have also come in pre-fabricated lengths that have not been easily modified by the contractor, either to accommodate specific roof pitches, or for convenience at the construction site.

Therefore, there has been needed an improved system and method for mounting a set of sturdy and attractive structural members for patio roofs built adjacent to existing structure as patio roof risers, to support and anchor the patio roof above the existing building roof area, while better maintaining the integrity of the existing building roof Preferably, such an improved system and method would comprise a fixably-hinged, pivotable-upon-installation, apparatus and would also be suitable for easily anchoring other structural items on buildings, such as eyebrow-type structures, or angled handrailing supports.

SUMMARY OF INVENTION

In accordance with an aspect and embodiment of the disclosure, there is provided an apparatus adapted for installation on a structural member having opposing sides to be adapted for interconnecting the structural member to another existing building structure. Such an apparatus may be beneficially adapted, for example, for installation on a patio roof riser for further installation on the roof or side surface of an existing building structure.

The apparatus comprises a base member adapted for being mounted to the existing building structure, and an attachment member extending from the base member, the attachment member having first and second opposing side surfaces which are wider than the attachment member is thick, the attachment member defining a plurality of holes therein, the attachment member adapted for installation attachment on the structural member by insertion of the attachment member into one of a slot, hole, opening, and groove, of the structural member.

The attachment member may be secured on the structural member by at least one fastener adapted for inserting a first end of the at least one fastener through a first portion of the structural member, continuing next through a one of the plurality of holes in the attachment member, and continuing next through another portion of the structural member. Thus, the attachment member's first and second opposing surfaces are adapted for being sandwiched between two portions of the structural member and therefore hidden from view upon installation.

This aspect of the disclosure thus also embodies a method for installation of such a structure comprising fixing the base member of the base member and attachment member in combination to the existing structure, inserting the attachment member into one of a slot, hole, and notch in the structural member, and fastening the structural member to the attachment member by passing a fastener, such as a heavy-duty bolt, first through a first portion of the structural member, then through a hole defined in the attachment member, and then through another portion of the structural member before securing the fastener to the attachment member and structural member thus comprised.

In one aspect and embodiment of the disclosure, for example for use in installing a roof, such as a patio roof or covering, onto and adjacent another existing roof, the base member is adapted to be attached directly to the existing roof over existing shingles using a plurality of lag screws to firmly attach the base member to the roof This is preferably accomplished with a sealant member interposed between the base member and the existing roof shingles, and installation of the base member on the roof is also not above an occupancy envelope of the existing structure, for example above the eaves of the building, to avoid any leakage into the existing structure.

Preferably, the attachment member is pivotably attached to and extends from the base member via a hinge that is fixable and able to be locked into place during installation, the attachment member being adapted for being pivoted around a pivot point and fixed at at least one of a plurality of desirable possible angles relative to the base member. The angle between the base member and attachment member is adjustable to allow mounting, in the case of a roof riser installation, on a plurality of roof angles, including a vertical angle in the case of mounting to an existing wall. Again, the waterproof nature of the existing structure is maintained by applying a waterproofing layer, such as a butyl rubber pad member, installed between the base member and the existing shingles.

In an embodiment of the invention, the base member is adapted for being mounted to the existing roof near a fascia and gutter portion of the existing roof, the base member comprising a plurality of holes adapted for a plurality of lag screws to firmly attach the base member to the roof, and with a waterproofing layer between the base member and the existing shingles. Such an installation would typically, preferably, be implemented out over the eaves of the existing structure, such that there is no danger of any leakage into rooms of the building through lag screw holes.

In accordance with an aspect and embodiment of the disclosure, the base member preferably comprises at least one receiver member, but preferably a slotted receiving member having two sidewalls adapted for receiving the attachment member between the slotted sidewalls and defining a plurality of radially-spaced pivot-pin holes in each the slotted sidewalls and the attachment member adapted for alignment upon pivoting of the attachment member around a pivot point. Each side wall of the receiver member comprises inner and outer wall portions, and preferably the pivot pin holes are defined to pass completely through each side wall. Thus, further, preferably, the attachment member defines another plurality of pivot-pin holes radially spaced at intervals around a pivot point of the attachment member and corresponding to the pivot point of the receiver member when the base member and the attachment member are pivotably attached.

The plurality of pivot-pin holes of the base member and the plurality of pivot-pin holes of the attachment member are adapted for alignment and receipt of at least one locking pin, but preferably a plurality of titanium locking pins are used. The attachment member is thus pivotable to any of a plurality of possible differing positions corresponding to at least one of a plurality of desired possible different angles relative to the base member, when at least one pair of aligned pivot-pin holes has received the at least one locking pin. Preferably, the number of holes in the receiver member and the number of holes in the attachment member allow a plurality of locking pins to be received in aligned such holes at any of a plurality of desired angles of the attachment member relative to the base member. Preferably such alignment occurs around diametrically-opposed pivot pin and pivot pin holes in concentrically-aligned radial orientations of the pivot pin holes in each the attachment member and each of the receiver members.

In another aspect and embodiment of the invention, the number of pivot pin holes in the attachment member may be different than the number of pivot pin holes in the receiver member, or vice-versa, and further, preferably, each of the numbers of pivot pin holes are numbered as evenly-divisible into 360 degrees into a radially-oriented pattern. This arrangement allows for alignment of one or more of the pivot pin holes at a larger number of possible angles between the attachment member and the base member of the structural support member. Thus, in a preferred embodiment, the attachment member has 12 pivot pin holes spaced at 30-degree intervals around the center of the pivot point, and the receiver member(s) has 10 pivot pin holes spaced at 36-degree intervals around the center of the pivot point. (Of course, the number of holes and angular configurations evenly divisible into 360 degrees may vary, and the 10 pivot pin holes spaced at 36 degrees apart may be in the attachment member, and vice versa, without departing from the true scope and spirit of the apparatus as claimed.) Thus, in the preferred configuration, alignment of one or more pivot pin holes is realized at increments of 6 degrees (as illustrated and described in FIGS. 2A, 2B and 7).

As just one example of the alignment of the pivot pin holes in the attachment member as it is pivoted, it is noted that with twelve (12) pivot pin holes evenly spaced on the attachment member the pivot pin holes are located at 0, 30, 60, 90, 120, 150, 180, 210,240,270, 300, and 330 degrees around the center of the pivot point. With ten (10) pivot pin holes in the receiver member, the pivot pin holes are located at 0, 36, 72, 108, 144, 180, 216, 252, 288, and 324 degrees around the center of the pivot point. When the attachment member is oriented perpendicular to the base member, pivot point holes in the attachment member and the receiver member are aligned at zero degrees and 180 degrees, and titanium locking pins may be inserted to lock the attachment member at that angle. As another example, if the attachment member is pivoted to 24 degrees, the pivot pin holes on the attachment member will be at 24, 54, 84, 114, 144, 174, 204, 234, 264, 294, 324 and 354 degrees. The pivot pin holes at 144 and 324 degrees will then be aligned. Twenty-nine other examples are illustrated and described in FIGS. 2A, 2B, and 7.

In another aspect and embodiment, the attachment member connects to a structural member which is of similar material and finish to the rest of the patio roof support structure, enhancing the visual aspect of the finished patio roof installation. In accordance with an aspect and embodiment of the disclosure, there is provided an apparatus adapted for installation on, and retaining of, a precut, pre-drilled, roof-riser structural member having opposing sides and left and right lower straddling portions on either side of a precut one of a slot, hole, opening, and groove.

Such a roof-riser structural member comprises, or defines, a plurality of transverse holes pre-drilled through the left and right lower straddling portions of the structural member, the apparatus being adapted for interconnecting the roof-riser structural member to an existing roof With this embodiment, there is provided a base member having a plurality of holes therein adapted for being mounted to the roof, preferably over the eves of the existing roof. Further, there is provided an attachment member pivotably extending from the base member, the attachment member having first and second opposing surfaces which are wider than the attachment member is thick, the attachment member also defining a plurality of holes therein adapted for alignment with the plurality of transverse holes pre-drilled through the left and right lower straddling portions of the roof-riser structural member.

The attachment member of this embodiment of the disclosure is adapted for installation attachment on the roof-riser structural member by insertion of the attachment member into the one of a slot, hole, opening, and groove of the roof-riser structural member such that the attachment member is like a blade adapted to be sandwiched between the left and right lower straddling portions of the roof-riser structural member. Thus positioned, upon installation, the straddling portions of the roof-riser structural member are positioned on either side of the attachment member with the pre-drilled transverse holes of the structural member aligning with the plurality of holes defined in the attachment member. With this embodiment, and other embodiments, there are also provided a plurality of transversely-oriented fasteners adapted for passing through and retaining the roof-riser structural member relative to the attachment member.

In accordance with another aspect of the disclosure, there is provided a combination multi-positionable, fixable-hinged, pivotable-upon-installation, attachment apparatus and roof-riser structural member adapted for interconnecting to an existing roof adapted for supporting an overlapping adjacent roof at any of a plurality of different angular positions of the adjacent roof relative to the existing roof. Such a combination apparatus and structural member comprises an attachment member pivotably extending from a base member, the attachment member having first and second opposing surfaces which are wider than the attachment member is thick, the attachment member defining a plurality of holes therein. The combination further comprises a roof-riser structural member having left and right lower straddling portions and having a plurality of transverse holes defined in the left and right lower straddling portions of the roof-riser structural member and aligned with the plurality of holes defined in the attachment member.

The foregoing aspects of the disclosure thus also embody another method for installation of such a structure comprising fixing the base member of the base member and attachment member to the existing structure, placing the attachment member into aligned pivotable relation with the receiver member(s) such that pivot pin holes on the attachment member and receiver member are concentrically aligned and pivotably held in place by loosely inserting a pivot member (preferably a flanged-head bolt) through concentrically-aligned central openings in the attachment member and receiver member(s), adjusting the angle of the attachment member relative to the base member to an appropriate pitch by pivoting the attachment member about the shared pivot point of the attachment member and the receiving member, pivoting to align at least a pair of pivot pin holes, but preferably a plurality of paired (or further preferably a set of three aligned pivot pin holes, two holes on the receiver members and one hole on the attachment member) pivot pin holes, inserting at least one pivot pin, but preferably a plurality of pivot pins, to lock the angular relation between the base member and the attachment member, covering the pivot pins to prevent them from dislodging, as preferably with a flange bolt and flange nut (e.g., a grade 8 high-strength flange bolt and flange nut), the flange nut being tightened down to lock the pivot pins in place on either outer sidewall portion of each receiver member, inserting an opposing end of the attachment member into one of a slot, hole, and notch in the structural member, and fastening the structural member to the attachment member by passing a fastener, but preferably a plurality of fasteners, such as with a heavy-duty galvanized bolt, first through a first portion of the structural member, then through a hole defined in the attachment member, and then through another portion of the structural member before securing the fastener to the attachment member and structural member thus comprised. Preferably, heavy-duty and decorative washers, such as bridge/timber washers may be used, wherein the bolts are spaced appropriately as well, all for structural strength purposes.

The base member of the combination multi-positionable apparatus and roof-riser structural member preferably comprises a receiver member having a plurality of sidewalls forming at least one slot adapted for receiving the attachment member, the receiver member side walls defining a plurality of radially-spaced pivot-pin holes around a pivot point. The attachment member of this aspect and embodiment preferably has first and second ends, the attachment member defining another plurality of pivot-pin holes radially spaced at intervals at the first end of the attachment member and around the pivot point, the receiver member(s) of the base member and the second end of the attachment member being attached pivotably relative to each other (pivotably that is until their angular relationship is locked relative to each other with the placement of pivot pins and a flanged bolt and flanged nut combination locking the pivot pins into place) when the base member and the second end of the attachment member are pivotably attached. Thus, the attachment member is pivotably attached to the base member via the receiving member, and the attachment member is adapted for being pivoted around a shared pivot point between the base member and the attachment member wherein they are able to be fixed at at least one of a plurality of desired possible angles relative to each other.

The pivot pin holes in the receiving member and the another plurality of pivot-pin holes in the attachment member are adapted for alignment and receipt of at least one locking pin, but preferably at least two locking pins, at a plurality of possible differing positions corresponding to a plurality of possible fixed angles of the attachment member relative to the base member. This is further evident as shown in FIGS. 2A, 2B, and 7, wherein there is shown and described a 12-pivot-pin hole and 10-pivot-pin hole combination yielding thirty-one (31) different possible angular variations, where at least one pair (preferably at least one set of three aligned pivot pin holes, two on the receiver member and one on the attachment member) of aligned pivot-pin holes has received the at least one locking pin.

The aforementioned fasteners of any of the foregoing embodiments may comprise a plurality of nut and bolt combinations, wherein each bolt is adapted for installation of the apparatus on the structural member together with fastening of a corresponding nut thereon such that an enlarged head of each bolt is adapted to be positioned closely adjacent a first (right) portion of the structural member (preferably on the other side of the bridge washer), and the corresponding nut is adapted to be positioned closely adjacent another (left) portion of the structural member (preferably on the other side of the bridge washer). Thus, the portions of the structural member are positioned between each the head and the bolt, the lower right portion of the structural member being adapted to be positioned between the head of the bolt and the attachment member, and the lower left portion of the structural member being adapted to being positioned between the nut and the attachment member when the apparatus is attached to the structural member.

Again, standard lock nuts and washers may be included as part of the fastener without departing from the system as claimed.

For a typical patio roof covering, the plurality of fasteners may each comprise a plurality of nut and bolt combinations, such as (2) ½"×71/2" galvanized bolts and (4) ½"×21/2" bridge/timber washers required for side to side shear. Each bolt is adapted for installation of the apparatus on the roof-riser structural member, together with fastening of a corresponding nut thereon such that preferably an enlarged head of each bolt is adapted to be positioned closely adjacent a right lower straddling portion of the roof-riser structural member, and the corresponding nut is adapted to be positioned closely adjacent a left lower straddling portion of the roof-riser structural member, the right lower straddling portion and the left lower straddling portion of the roof-riser structural member being thus positioned between each the head and the bolt (including any washers), the right lower straddling portion of the roof-riser structural member being adapted to be positioned between the head of the bolt (including any washer) and the attachment member, and the left lower straddling portion of the roof-riser structural member being adapted to being positioned between the nut (including any washer) and the attachment member, as shown in FIG. 3, when the apparatus is attached to the roof-riser structural member.

In accordance with any of the foregoing aspects and embodiments, the number of pivot-pin holes in the receiver member may be different than the number of pivot-pin holes in the attachment member such that a larger number of possible fixed angles may be achieved upon alignment of the pivot-pin holes in the receiver member and the attachment member as further illustrated in FIGS. 2A, 2B, and 7.

Also, in connection with any of the foregoing embodiments pertaining to a pivotable attachment member, there may be provided an interconnecting and covering member for interconnecting the receiver member and the attachment member at the pivot point shared between the receiver member and the attachment member and which is adapted to cover and secure the locking pins within aligned pivot-pin holes of the receiver member and the attachment member.

Preferably, as described previously in connection with another embodiment, the number of holes in the receiver member and the number of holes in the attachment member allow a plurality of locking pins to be received in aligned such holes at any of a plurality of different desired angles of the attachment member relative to the base member.

The combination multi-positionable attachment apparatus and roof-riser structure member are thus adapted for interconnecting to an existing roof adapted for supporting an overlapping adjacent roof at any of a plurality of 5 different angular positions of the adjacent roof relative to the existing roof. Such a combination comprises: a base member having a plurality of holes therein adapted for being mounted to the existing roof near a fascia and gutter portion of the existing roof, an attachment member pivotably extending from the base member, the attachment member having first and second opposing surfaces which are wider than the attachment member is thick, the attachment member defining a plurality of holes therein.

The combination of this aspect of the disclosure further comprises a roof-riser structural member having left and right lower straddling portions and having a plurality of transverse holes defined in the left and right lower straddling portions of the roof-riser structural member and aligned with the plurality of holes defined in the attachment member.

There are employed a plurality of transversely-oriented fasteners retained within the transverse holes of the roof-riser structural member and the aligned holes of the attachment member, the fasteners attaching and retaining the roof-riser structural member on the attachment member, wherein the attachment member is inserted between the left and right lower straddling portions of the roof riser structural member such that the attachment member is like a blade sandwiched and at least partially hidden between the left and right lower straddling portions of the roof-riser structural member.

With the multi-pitch angle adjustment feature thus described, it will be further appreciated that fine tuning of adjustments to pitch may further be accomplished by first hand-tightening the attachment members to hand tight snug. Then using a torpedo level, the plumb of structural members may be adjusted to perfect plumb, whereupon bolts may be tightened for permanent installation. In this way the system and method of the present disclosure allows for a very large number of pitches for structural installations.

In this later-described embodiment, the base member further comprises a receiver member, preferably a slotted and substantially-upper-circular (partially for appearance purposes and partially for structurally-sound functional purposes) receiver member having dual sidewalls with each sidewall having inner and outer sidewall portions, adapted for receiving the attachment member and defining a plurality of radially-spaced pivot-pin holes through each sidewall portion and oriented radially, preferably evenly-spaced, around a pivot point, and the attachment member preferably has first and second ends.

The attachment member of this embodiment also preferably defines another plurality of pivot-pin holes radially spaced at intervals at the first end of the attachment member and around the pivot point, and the receiving member of the base member and the second end of the attachment member are attached pivotably relative to each other such that the pivot pin holes and the another plurality of pivot-pin holes are concentrically-aligned upon pivotable attachment during installation and thereby adapted for alignment of the pivot pin holes as well and receipt of at least one locking pin at a plurality of possible differing angular positions of the base member relative to the attachment member. Such positions correspond to a plurality of possible fixed angles of the attachment member relative to the base member when at least one pair of aligned pivot-pin holes has received the at least one locking pin.

As with previously-described embodiments, the combination of this embodiment is provided wherein the number of holes in the receiver member is preferably different than the number of holes in the attachment member. This 5 allows that a larger number of possible fixed angles may be achieved upon alignment of the holes in the receiver member and the attachment member as further described in connection with FIGS. 2A, 2B, and 7.

The various embodiments of the present disclosure address shortcomings of prior systems, in that now there is provided an easy-to-install 10 roof-riser structural member which enables sufficient clearance between an overlapping adjacent patio cover/roof to allow plenty of light and in such a way that a proper angle may be maintained with sufficient headroom to allow proper drainage off of the installed patio roof cover. Further, the present disclosure provides a visually pleasing riser for supporting such a roof, since the attachment member is actually hidden inside of a slot of structural member supporting the added roof Still further, the system described herein may be used to attach eyebrow-type structures to the side of a building, to install angled handrails to buildings, or other structural members to existing buildings.

It will be appreciated by those skilled in the art that there are various possible combinations of the above-described elements and sub-elements for various embodiments of the invention, whether such elements and sub-elements be combined in whole or in part, which may be employed without departing from the scope and spirit of the invention as claimed.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

BRIEF DESCRIPTION OF DRAWINGS

FIG. 7 is a table showing possible attachment member angle positions relative to a base member and associated pivot pin alignment identification information for each such angular position.

DESCRIPTION OF EMBODIMENTS

Figure 1:
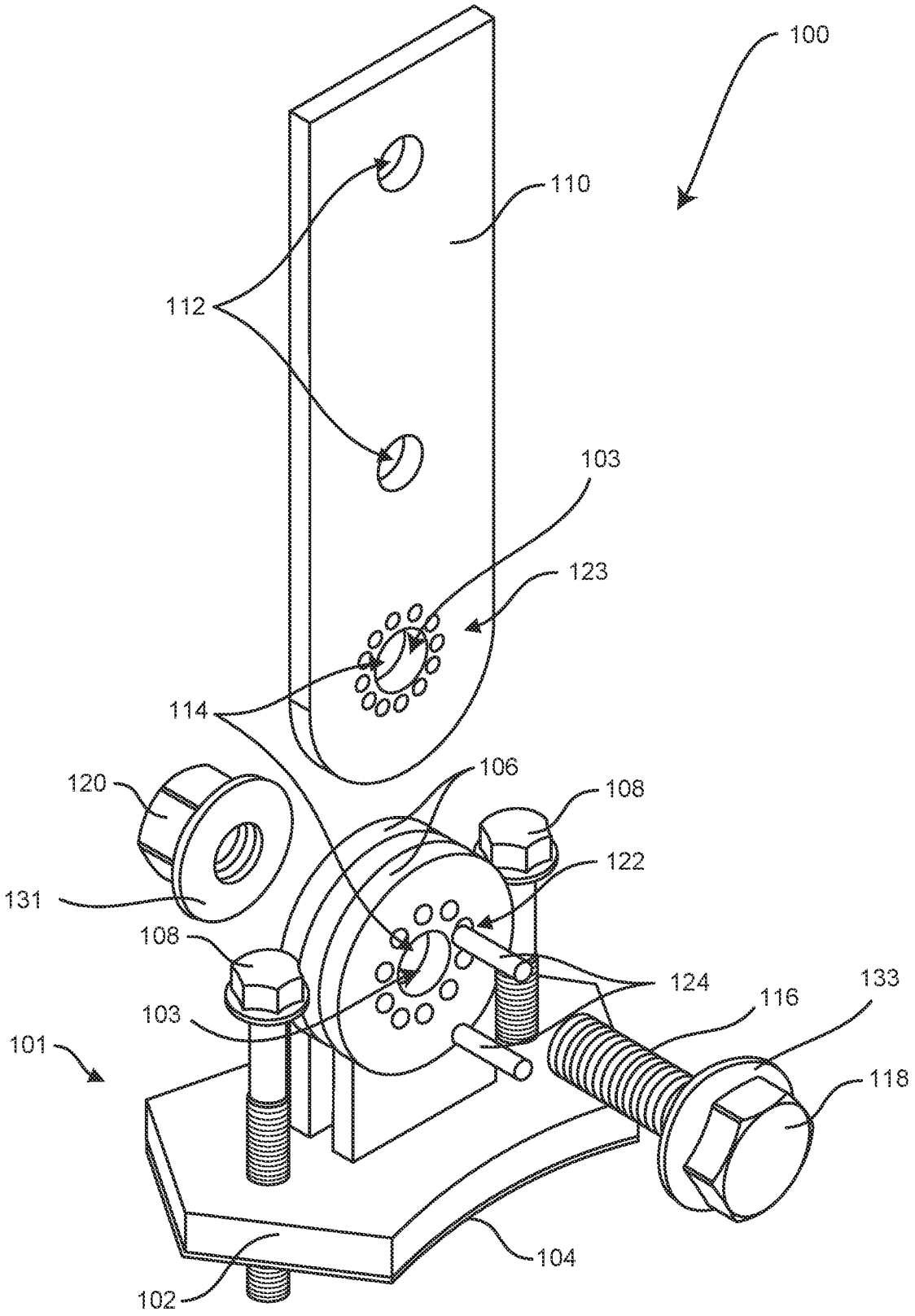
FIG. 1 is a partially-exploded side perspective view of components of a structural support apparatus according to an aspect and embodiment of the disclosure.

Referring to FIGS. 1-6, in accordance with one or more aspects of the invention, there is provided a structural support apparatus 100 comprising: a base member 101 comprising a mounting plate 102 that can be secured to an existing roof 150, 153, or the side of a building, by means of lag screws 108, and one or more preferably concentrically-aligned receiver members 106, preferably integral with the mounting plate 102 and adapted to be attached to a pivotable attachment member 110.

The attachment member 110 defines a plurality of holes 112 allowing the attachment member to be attached to a structural member 126 with a plurality of fasteners 134, such as nut and bolt combinations 134, 138, such as (2) ½"×71/2" galvanized bolts, and (4) ½"×21/2" bridge/timber washers 136, required for side to side shear, wherein each bolt is adapted for installation of the apparatus 100 on the roof-riser structural member 126 together with fastening of a corresponding nut 138 thereon.

Such installation is accomplished preferably such that an enlarged head 135 of each bolt 134 is adapted to be positioned closely adjacent a right lower straddling portion 129 (FIG. 3) of the roof-riser structural member 126, and the corresponding nut 138 is adapted to be positioned closely adjacent a left lower straddling portion 127 of the roof-riser structural member, the left lower straddling portion 127 and the right lower straddling portion 129 of the roof-riser structural member 126 being thus positioned between each the head 135 of the bolt 134 and the nut 138 (including any washers 136), the right lower straddling portion of the roof-riser structural member being adapted to be positioned between the head 135 of the bolt 134 (including any washer 136) and the attachment member 110, and the left lower straddling portion 127 of the roof-riser structural member 126 being adapted to being positioned between the nut 138 (including any washer 136) and the attachment member 110 when the apparatus 100 is attached to the roof-riser structural member.

The structural apparatus 100 may also be used to install an eyebrow-type structural member, an angled handrail, or other structural member, as will be appreciated by those skilled in the art. Preferably, a waterproofing layer 104, such as a butyl rubber layer 104, is interposed between a bottom portion of the mounting plate 102 and the existing roof structure 150.

Figure 5:
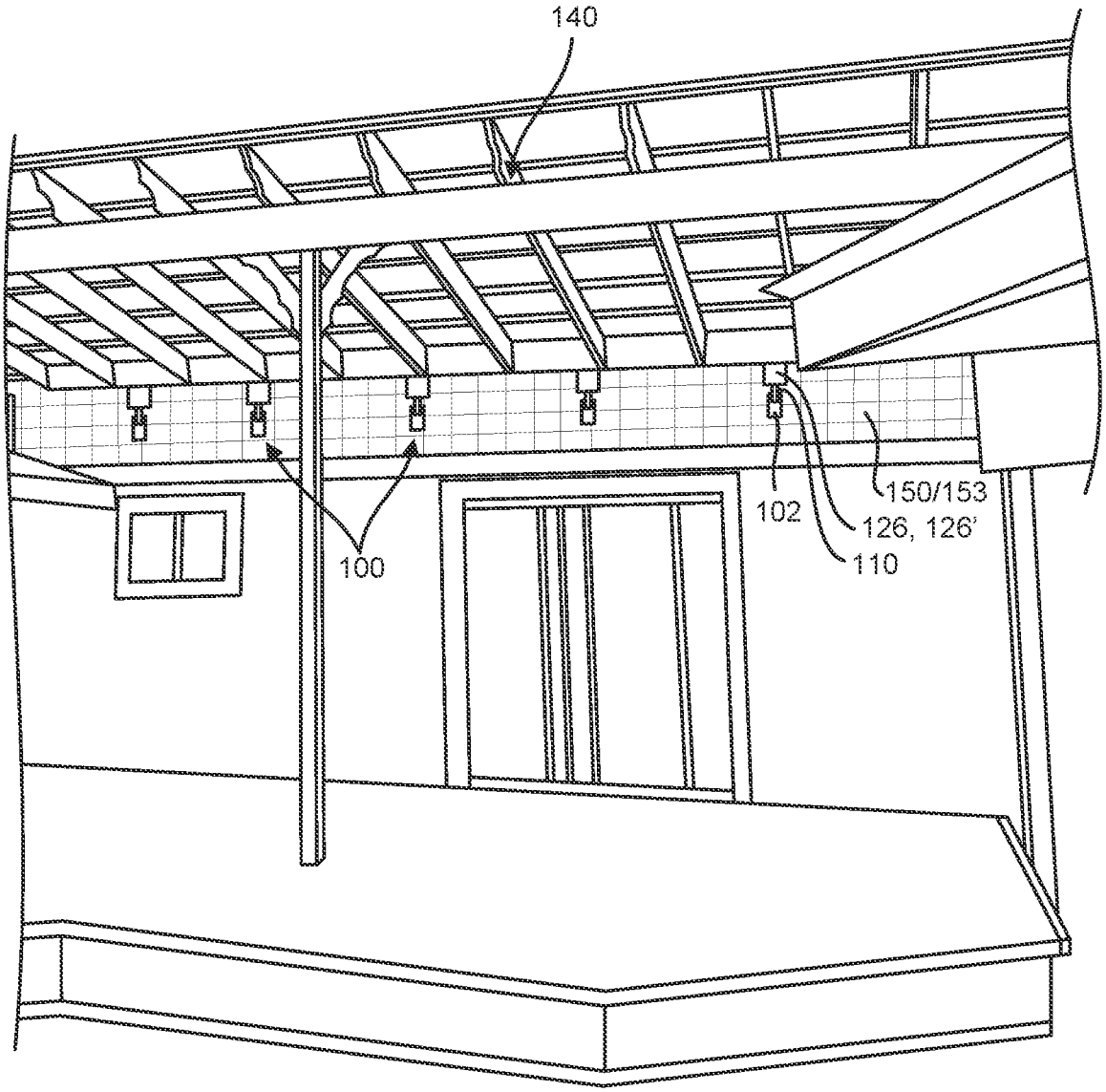
FIG. 5 is a perspective view of a completed installation of a patio roof showing the elevated patio roof supported on one side by a plurality of combined support structure apparatus and riser structural members on an existing sloped roof.
Figure 6:
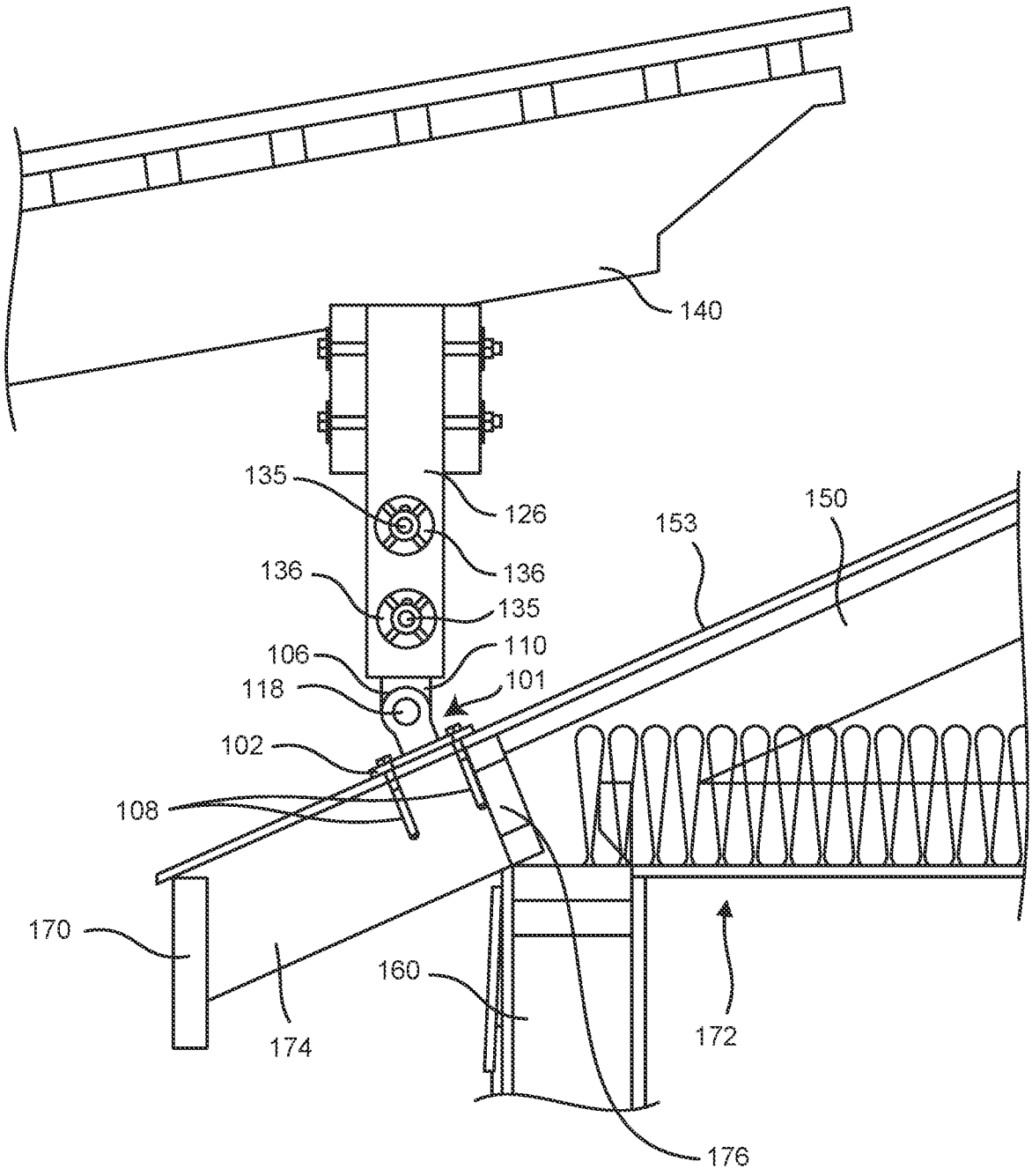
FIG. 6 is a right side view of a partial existing building roof structure showing a structural support apparatus and structural member combination attached to the partial building roof structure and supporting a partial patio cover roof structure in accordance with an aspect and embodiment of the disclosure.

Referring specifically to FIGS. 1, 5 and 6, the mounting plate 102 is adapted to be installed on an existing roof 150 on top of existing shingles or other roof coverings 153 by means of lag screws 108. The ability to install the base member 100 over existing roof materials, along with the waterproofing layer 104 between the mounting plate 102 and the existing roof 150, 153, allows the waterproof nature of the existing roof to be preserved.

To further ensure waterproofing in such an installation on a roof structure 150, 153, and as can be seen in FIG. 6, the structural support member 100 is preferably installed outside of the occupancy envelope 172 of the existing structure, to avoid any leakage into the existing structure. That is, when installed on a surface 153 of an existing roof 150, the structural support member 100 is preferably installed at a location just outside of an outer bearing wall 160 as shown in FIG. 6, and adjacent, e.g., just beyond an angled extension 176 extending up from the bearing wall 160. In other words, and for maximum headroom of a patio roof structure 140, the mounting plate 102 of the structural support apparatus 100 is preferably installed away from an outer fascia member 170, but between the outer fascia member and the extension member 176 from bearing wall 160, so as to be outside of the building occupancy envelope 172. Further, preferably for such an installation for a patio roof riser combination 100, 126, the plate member 102 is preferably screwed with lag bolts 108 through the roof covering portion 153 and into tail portions 174 of rafter members extending beyond bearing wall 160 as shown in FIG. 6.

The receiver members 106 of base member 101 are preferably partially cylindrical at upper locations thereof and extend vertically from the mounting plate 102. The receiver members define a hole 103 acting as a pivot point 114, and a plurality of pivot pin holes 122. The attachment member 110 is attached to the receiver members 106 by means of a pivot connecting member 116 that is inserted in the hole 103 to establish the pivot point 114 of both the receiver members and the attachment member. The attachment member 110 may pivot to a plurality of angles as shown in FIGS. 2A and 2B relative to the base member and is locked into the desired angle by means of preferably titanium locking pins 124 inserted into aligned pivot pin holes 122.

In another aspect and embodiment of the invention, the pivot pin holes 122 are placed radially in the receiver members 106 at a consistent distance from the center of the pivot point 114, and corresponding pivot pin holes 123 are placed radially in the attachment member 110 at the same distance from the center of the pivot point. As the attachment member 110 is pivoted, one or more of the pivot pin holes 122 in the receiver member 106 and the corresponding pivot pin holes 123 in the attachment member align. Where the pivot pin holes 122 and 123 align, one or more locking pins 124 may be inserted to secure the desired angle.

In accordance with a preferred embodiment, the pivot connecting member 116 comprises a flanged head pivot connecting bolt 118 and a flanged pivot connecting nut 120. By inserting the pivot connecting bolt 118 in the holes 103 and through pivot points 114 of both the receiver members 106 and the attachment member 110, the attachment member may thus be pivoted to a desired angle. Once the locking pins 124 have been inserted into aligned holes 122, 123, the flanged pivot connecting nut 120 may be fastened on the pivot connecting bolt 118, to the effect that the pivot connecting member bolt flange 133 and the pivot connecting nut flange 131 covers and secures the locking pins 124 in place. The partial cylindrical structure at the upper locations of the receiver members make them both appealing to the eye and also make them well-adapted for supporting forces to be exerted at the central openings through them, at the angular pivot pin through holes in them, and from the flange bolt and flange nut surfaces thereon.

Figure 2A:
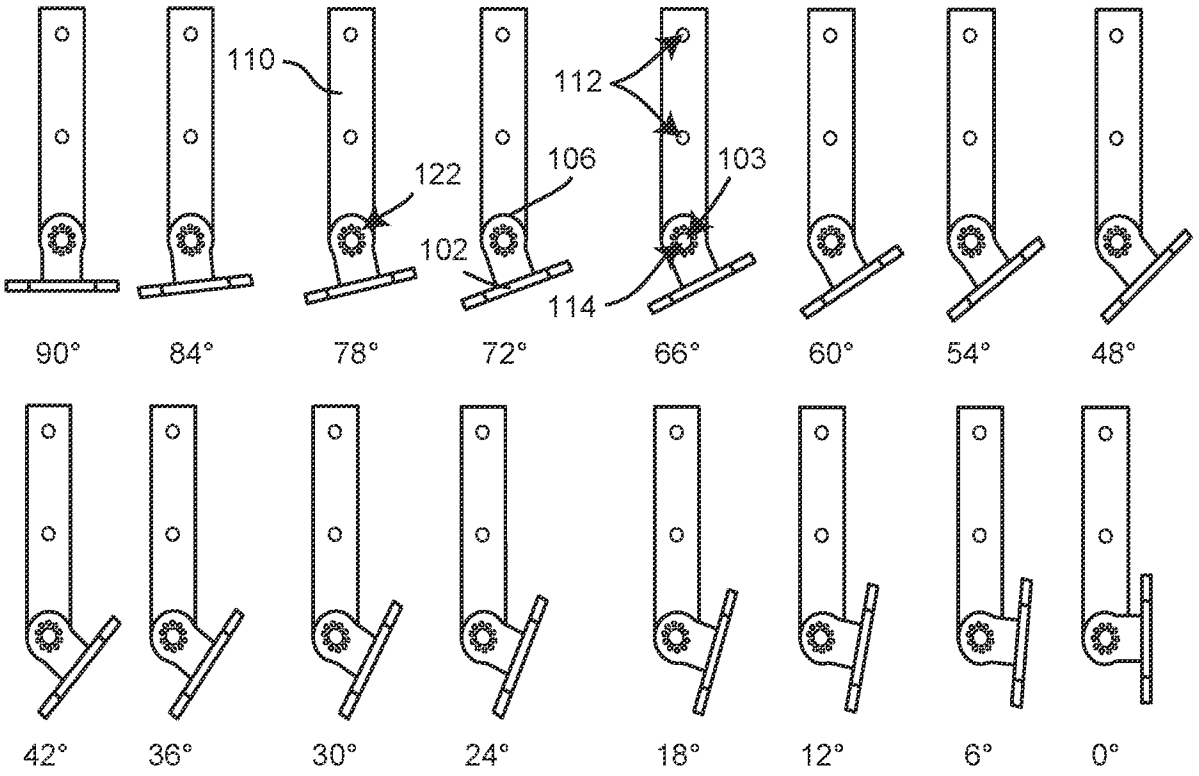
FIG. 2A is a side view of a plurality of structural support apparatus according to an aspect and embodiment of the disclosure and showing a portion of a variety of angles at which each structural support apparatus may be locked.
Figure 2B:
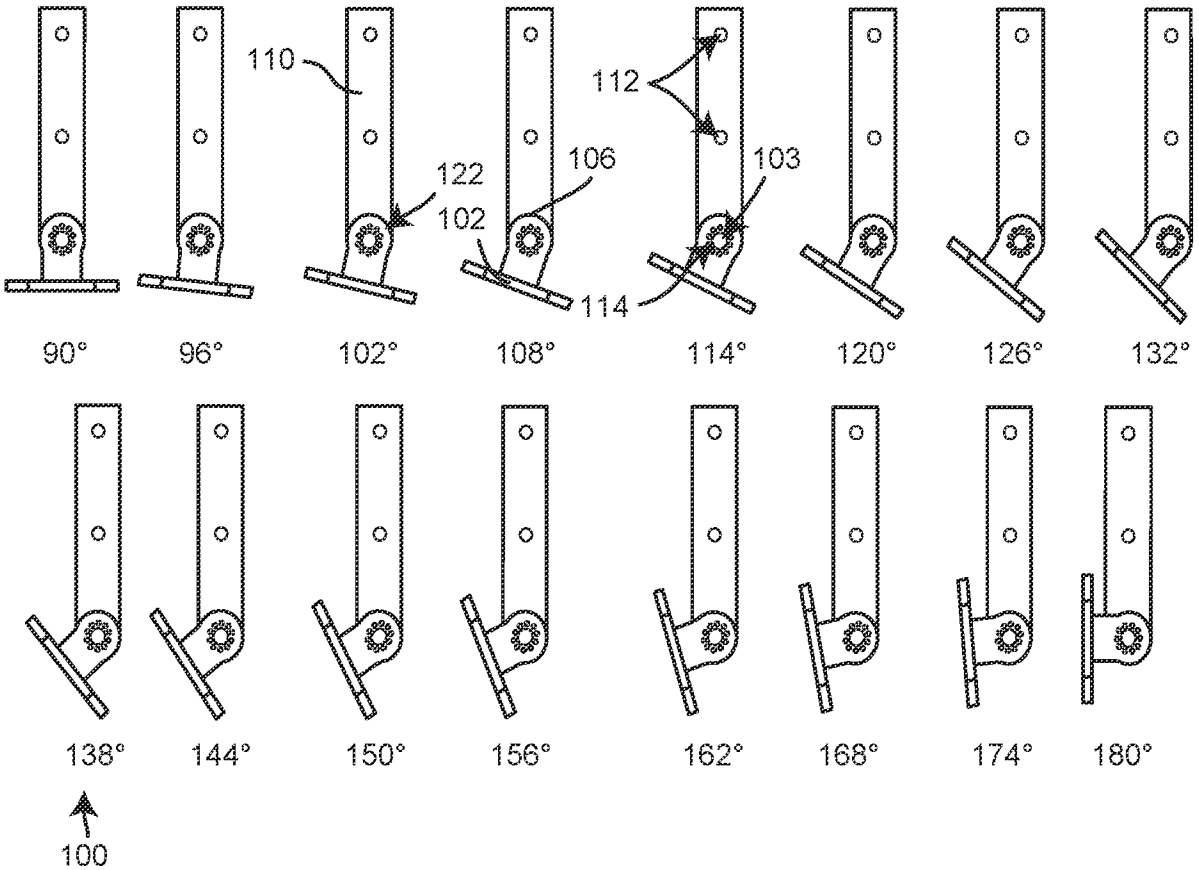
FIG. 2B is a side view of another plurality of structural support apparatus according to an aspect and embodiment of the disclosure and showing another portion of a variety of angles at which each structural support apparatus may be locked.

Referring specifically to FIGS. 2A and 2B, it is noted that the installation of the base member 100 may be done on existing roofs and building sides of a variety of pitches. Once the base member 101 is attached to an existing roof, the installation of a vertical structural member 126 (such as a vertically-oriented structural member for a roof riser) is facilitated by pivoting the attachment member 110 to a vertical position and securing it in place by means of the locking pins 124 inserted in aligned pivot pin holes 122, 123.

In another aspect and embodiment of the invention, the number of pivot pin holes 122 in the attachment member 110 may be different than the number of pivot pin holes in the receiver member 106. This arrangement allows for alignment of one or more of the pivot pin holes 122, 123 at a larger number of possible desired angles. In a preferred embodiment, the attachment member 110 has twelve (12) pivot pin holes spaced at 30 degrees around the center of the hole 103, around pivot point 114, and the receiver member has ten (100 pivot pin holes spaced at 36 degrees around the center of the hole 103, around center of the pivot point 114. In this configuration, alignment of one or more pivot pin holes 122, 123 is realized at increments of 6 degrees (as shown in FIGS. 2A and 2B), resulting in 16 different angles ranging from 0 degrees to 180 degrees.

Referring to FIGS. 2A, 2B, and 7, together these FIGS. illustrate a preferred embodiment wherein the attachment member preferably has twelve (12) equally-spaced, and radially-spaced, transversely-oriented, pivot pin holes 123 around a central pivot point 114 opening 103 in the lower end of the attachment member (as can also be seen in FIG. 1). In this preferred embodiment, the slotted receiving member sidewalls 106 each preferably has ten (10) equally-spaced, and radially-spaced, transversely-oriented, pivot pin holes 122 around central pivot point 114 openings 103 in each lateral sidewall 106 thereof. Note that each of the numbers of pivot pin holes 122, 123 is evenly divisible into 360 degrees, which makes this combination preferred since it yields, as further described in connection with FIGS. 2A, 2B, and 7, a large and sufficient number of positions for most structural member applications, but it also allows for sufficient material to sufficiently handle forces associated with such applications. Nevertheless, it will be appreciated that other combinations of pivot pin numbers in attachment members and receiver members may be used for the applications referred to herein, namely for added roof structural member applications, for eye-brow structure applications, and for hand-rail support applications, without departing from the scope of the system and apparatus as claimed.

In FIG. 7, there are provided along an upper left-hand column, a plurality of rotated angle combinations made in 6-degree increments and numbered 1-31 for a 12-pivot-pin-hole attachment member as indicated by the upper row of numbers in the table of 0, 30, 60, . . . 330, corresponding to the radially-oriented pivot pin holes 123 in a first vertical position of such as illustrated by row number 1. Thus, as the attachment member is rotated in 6-degree increments, each pivot pin hole is likewise advanced 6 degrees from its previous position.

The table further correlates these varying angle positions with corresponding pivot pins 122 at a lower portion of the table with rows labeled 1-10 corresponding with 10 such pivot pin holes 122. Thus, as the attachment member is rotated in 6-degree increments, the table illustrates by calling out which row number 1-31 associated with the pivot pin holes 123 is being considered (i.e., for an 18-degree rotation of the attachment member, row number 4 would be considered) and shows the corresponding radial locations of the successive pivot pin holes 123. Then, below in the table, it can be seen that row 4, for example, associated with an 18-degree rotation of the attachment member, correlates that alignment of the pivot pin holes 122 will occur with pivot pin holes 123 at 108 degrees and 288 degrees. In this way, it will be appreciated that there are 31 different possible combinations of degree rotation ranging between zero and 180 degrees as further shown in FIGS. 2A and 2B.

This aspect and disclosure of the embodiment makes the apparatus a fixable-hinged, pivotable-upon-installation apparatus in that it makes it possible to easily adjust and thereafter fix the structural attachment member 100 to any desired pitch angle for a roof installation, an eyebrow-type installation, or a handrail support installation. Further adjustments to pitch may also be achieved by making the diameter of the holes 112 of the attachment member slightly smaller than the diameter of through holes in structural members 126, 126' before final tightening, as further described herein. Thus, together, these advancements in this field make for much easier and effective installation of support structures.

Thus, as an example of the alignment of the pivot pin holes 123 in the attachment member 110 as it is pivoted, it is noted that with 12 pivot pin holes 123 evenly spaced on the attachment member 110 the pivot pin holes 123 are located at 0, 30, 60, 90, 120, 150, 180, 210,240,270, 300, and 330 degrees around the center of the pivot point 114. With 10 pivot pin holes 122 in the receiver members 106, the pivot pin holes are located at 0, 36, 72, 108, 144, 180, 216, 252, 288, and 324 degrees around the center of the pivot point 114. When the attachment member 110 is oriented perpendicular to the mounting plate 101 of the base member 100, pivot point holes 123 in the attachment member 110 and pivot point holes 122 the receiver members 106 are aligned at zero degrees and 180 degrees, and titanium locking pins 124 may be inserted to lock the attachment member 110 in those pivot pin holes and at that angle, as can be seen in the table in FIG. 7. (Please note that the 360-degree position illustrated in the table is the same as 0-degree position).

As another example, if the attachment member 110 is pivoted to 24 degrees, the pivot pin holes 123 on the attachment member will be at 24, 54, 84, 114, 144, 174, 204, 234, 264, 294, 324 and 354 degrees. Thus, the pivot pin holes at 144 and 324 degrees will then be aligned as can be verified in FIG. 7.

Figure 3:
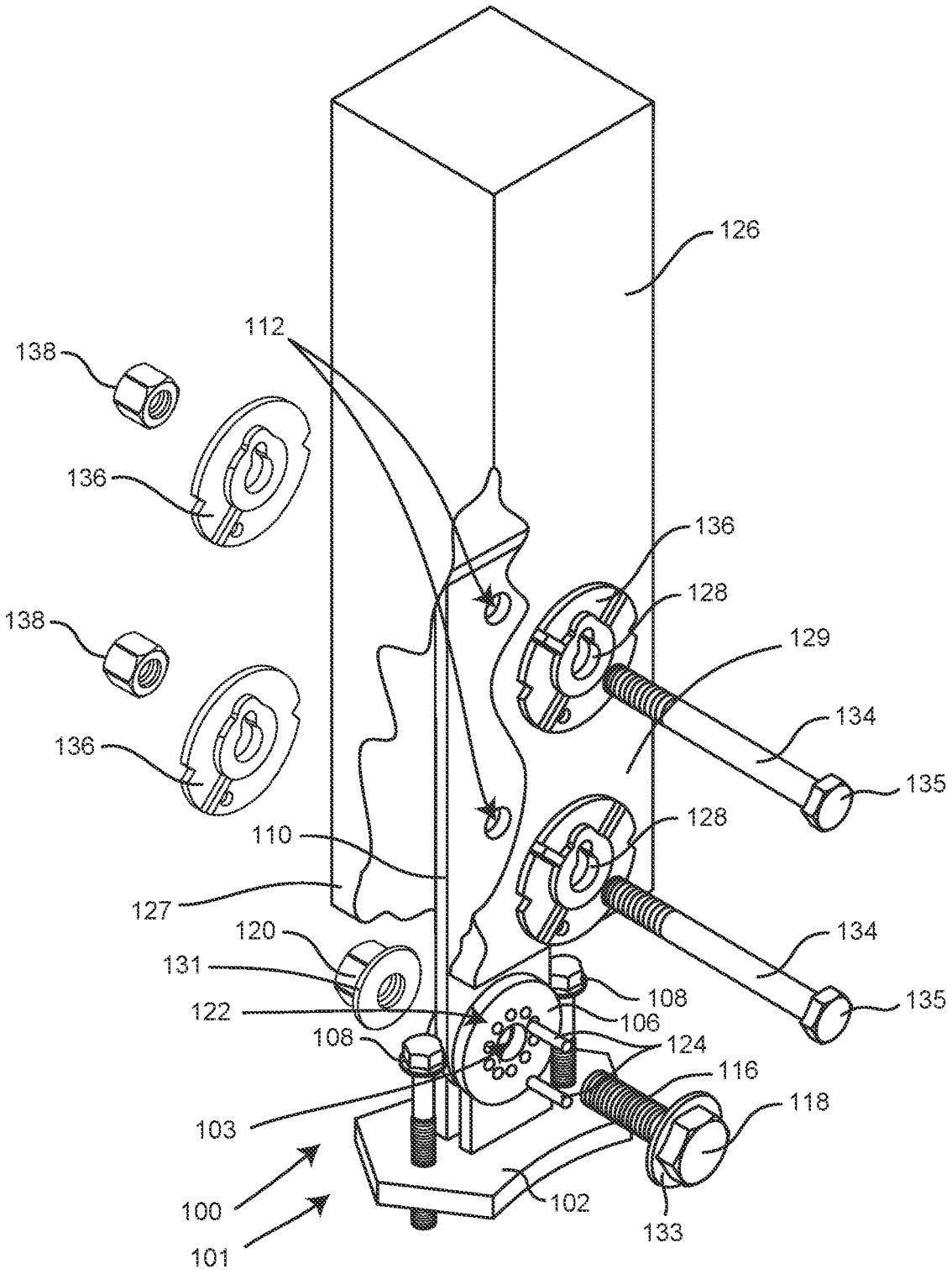
FIG. 3 is a partially-exploded side perspective view of a structural support apparatus in combination with, illustrating how the structural support apparatus may be attached to, for example, a riser-type structural member.
Figure 4:
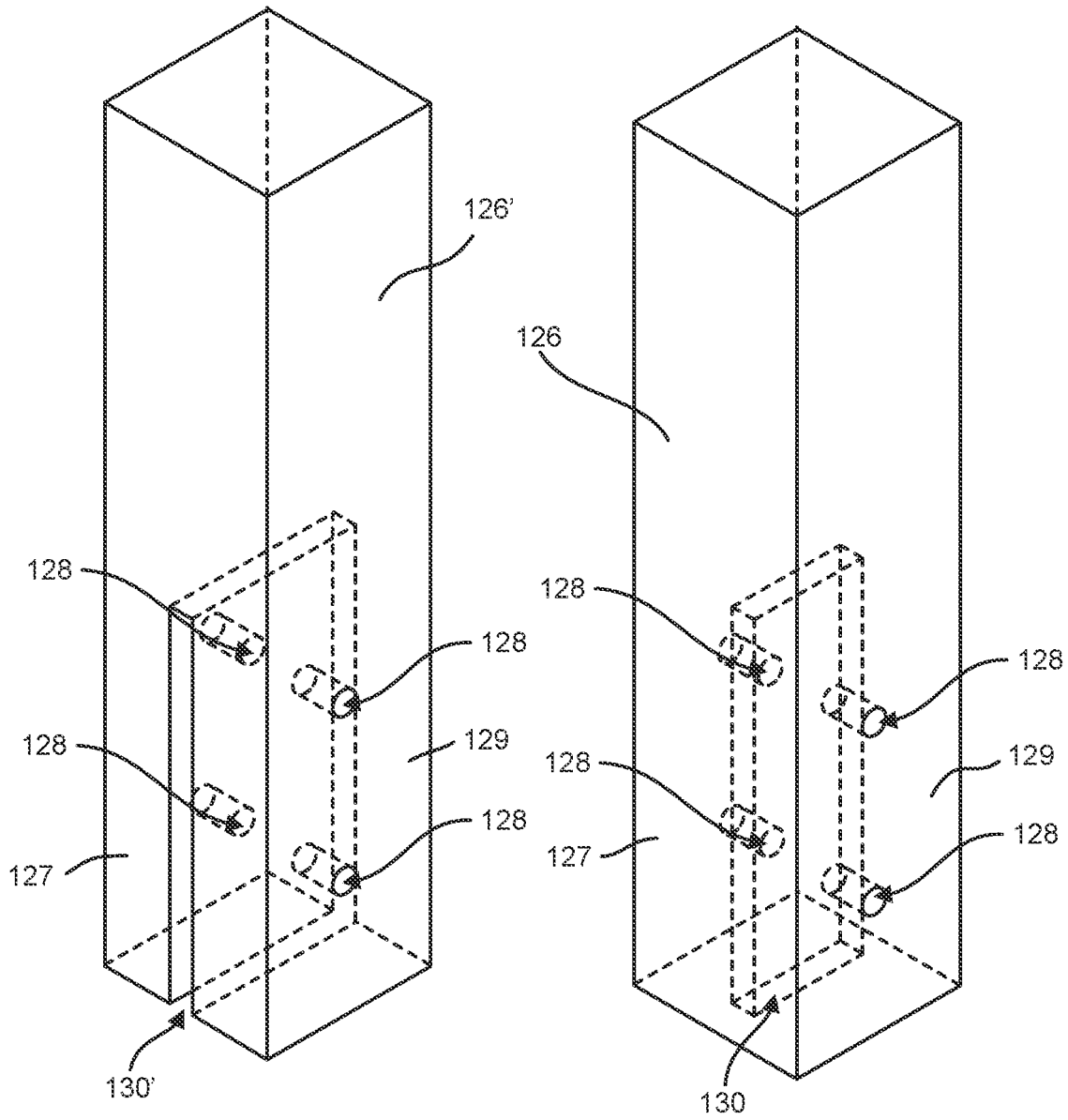
FIG. 4 is a perspective view of two alternative embodiments for structural members showing a slot in each riser-type structural member where the attachment member will be inserted and secured.

Referring specifically to FIGS. 3 and 4, there are provided a structural support member 100 and riser-type structural member 126 combination (FIG. 3) and pre-cut alternate riser-type structural members 126, 126' (FIG. 4). As shown in FIG. 4, structural member 126 has cut therein a slot 130 that is constrained, or closed, both at an end and on either side, whereas structural member 126' has cut therein an open slot 130' constrained, or closed, only at an end thereof, and such that each side of the slot is open. The riser mounting holes 128 are located to correspond with the mounting holes 112 in the attachment member 110.

Of course, slot 130 in structural member 126 allows the attachment member 110 to be more completely hidden within the structural member 126 upon installation, whereas slot 130' in structural member 126' allows edges of the attachment member 110 to be seen within the structural member upon installation. Each structural member 126, 126' has pre-drilled transversely-oriented mounting holes 128 passing through left 127 and right 129 straddling portions of the structural members.

Once the plate member 102 of the base member 101 has been mounted to a building structure, such as a roof 150, 153 (FIG. 6), and the attachment member 110 has been secured at a desired angle, a riser structural member 126, 126' may be installed on the attachment member 110 by inserting the attachment member into a riser mounting slot 130, 130', respectively. The riser structural member 126, 126' is secured to the attachment member 110 by means of riser connecting, or fastening, members 134 inserted through riser mounting holes 128 and the attachment mounting holes 112. The insertion of such fastening members 134 is accomplished as installation of the structural support apparatus 100 onto an existing structure followed by installation of the structural member 126, 126' onto the structural support apparatus, comprising the following steps: fixing the mounting plate 102 of the base member 101 and attachment member 110 in combination to the existing structure, inserting the attachment member 110 into one of a slot, hole, and notch 130, 130' in the structural member 126, 126', and fastening the structural member 126, 126' to the attachment member 110 by passing a fastener 134, such as a heavy-duty bolt, first through a first portion 129 of the structural member, then through a hole 112 defined in the attachment member 110, and then through another portion 127 of the structural member before securing the fastener 134 to the attachment member 110 and structural member 126, 126' with a nut 138. Of course, it will also be appreciated that there may be provided intermediate washers 136, such as bridge/timber washers, interposed between a head portion 135 of each bolt 134 and the right straddling portion 129 of the structural member 126, 126', with another washer interposed between each nut 138 and the left straddling portion 127 of the structural member 126, 126'.

In a preferred aspect and embodiment of the disclosure, the riser connecting member 134 thus comprises: a riser connecting bolt 134, two riser connecting washers 136, and a riser connecting nut 138, as shown in FIG. 3. In alternative embodiments, the riser connecting members may be comprised of decorative elements that are consistent with other mounting hardware used in the construction of a structural support member, for example for a roof-riser-type patio roof 140, thus adding to the visual attractiveness of the finished structure.

In a preferred embodiment, the riser-type structural members 126, 126' may comprise a 4 inch by 4 inch wood post which may be customized, for example, squared off at an upper end for interfacing with patio roof 140 members, such as a cross member, and angle cut at a lower end for corresponding with, for example, the pitch of an existing roof 150, 153. Such riser-type structural members 126, 126' may also be cut for desired height at the work site, and the riser mounting slots 130, 130', together with riser mounting holes 128, may be realized using common construction tools and techniques available at the work site.

In another aspect and embodiment of the invention, the structural attachment member 110 may have smaller-diameter holes 112 than the diameter of the structural member 126, 126' mounting holes 128. This will allow the installer to complete fine adjustments of the riser-type structural member 126 to achieve true vertical during installation, even if the attachment member 110 is not quite exactly at vertical after aligned holes 122, 123 are pinned with pivot pins 124. In this way, installers are enabled in more easily achieving true plumb level for the riser-type structural members 126, 126' for more accurate construction.

Thus, by way of example, it will be appreciated that this invention provides the installer with the ability to install the apparatus 100 without cutting into an existing roof, and the ability to adjust the mounting angle of a riser structural member 126, 126' to accommodate various roof pitches. Further, it will be appreciated that the present invention allows a more visually-appealing, and easy-to-accomplish installation, where solid structural support may be achieved without undue effort and in a way that enhances the use of natural building materials (such as wooden structural members) otherwise employed in surrounding existing building structures.

While a preferred embodiment of the present invention has been shown and described, it will be apparent to those skilled in the art that many changes and modifications may be made without departing from the invention in its broader aspects. For example, it will be appreciated that one of ordinary skill in the art may mix and match the various components of the various embodiments of the invention without departing from the true spirit of the apparatus and method as claimed. The appended claims are therefore intended to cover any changes and modifications as fall within the true spirit and scope of the invention.

The invention claimed is:

1. A structural support apparatus for use in interconnecting an additional structure to an existing building structure, comprising:

a base member including:

a mounting plate configured to be mounted to the existing building structure, and a receiver member having a through hole that defines a pivot point; and an attachment member configured to be pivotably attached to the base member, wherein a first plurality of pivot pin holes are arranged radially around the pivot point of the receiver member, a through hole in a first end of the attachment member defines the pivot point in the attachment member, and a second plurality of pivot pin holes are arranged radially around the pivot point of the attachment member, wherein the first end of the attachment member is pivotably attached to the receiver member via at least one locking pin inserted through one of the first plurality of pivot pin holes formed in the receiver member and one of the second plurality of pivot pin holes formed in the attachment member, and a second end of the attachment member is coupled directly or indirectly to the additional structure, wherein the second end of the attachment member is coupled indirectly to the additional structure at least in part by:

the attachment member being secured to a structural member via at least one fastener; and the structural member being attached to the additional structure to anchor the additional structure to the existing building structure, and wherein the second end of the attachment member is inserted into one of a slot, hole, opening, and groove formed in the structural member, and the structural member includes left and right lower straddling portions on either side of the one of a slot, hole, opening, and groove, and a plurality of transverse holes pre-drilled through the left and right lower straddling portions.

2. The structural support apparatus of claim 1, wherein the attachment member is pivotable to a plurality of possible angles relative to the base member.

3. The structural support apparatus of claim 1, wherein the structural member is a roof riser.

4. The structural support apparatus of claim 1, wherein the attachment member includes a plurality of holes configured to align with the plurality of transverse holes pre-drilled through the left and right lower straddling portions of the structural member.

5. The structural support apparatus of claim 1, wherein in an assembled state in which the second end of the attachment member is inserted into the structural member, the first and second opposing surfaces of the attachment member are hidden from view.

6. The structural support apparatus of claim 1, wherein the attachment member has a first opposing surface and second opposing surface, a width of which is wider than a thickness of the attachment member.

7. The structural support apparatus of claim 1, wherein the receiver member is a first receiver member, the base member further includes a second receiver member having a through hole defining the pivot point and a third plurality of pivot pin holes arranged radially around the pivot point, the third plurality of pivot pin holes in the second receiver member being in alignment with the first plurality of pivot pin holes in the first receiver member, and the at least one locking pin is inserted through one of the first plurality of pivot pin holes in the first receiver member, one of the second plurality of pivot pin holes in the attachment member, and one of the third plurality of pivot pin holes in the second receiver member.

8. The structural support apparatus of claim 1, wherein a number of the first plurality of pivot pin holes in the receiver member is different from a number of the second plurality of pivot pin holes in the attachment member.

9. The structural support apparatus of claim 1, wherein the first plurality of pivot pin holes in the attachment member are arranged at 30 degree increments around the pivot point, and the second plurality of pivot pin holes in the receiver member are arranged 36 degree increments around the pivot point.

10. The structural support apparatus of claim 1, wherein the base member is attached to a roof of the existing building structure via screws installed over existing shingles, and the structural support apparatus further comprises a waterproofing layer between the base member and the existing shingles.

11. The structural support apparatus of claim 1, wherein the base member is attached to a vertical wall of the existing building structure via screws, and the structural support apparatus further comprises a waterproofing layer between said base member and the existing vertical wall.

12. The structural support apparatus of claim 1, further comprising:

a pivot connecting member configured to attach the attachment member to the receiver member via the pivot point, the pivot connecting member being configured to cover and secure the at least one locking pin.

13. The structural support apparatus of claim 1, wherein the base member includes a plurality of holes configured for mounting the base member to the existing structure via fasteners.

14. The structural support apparatus of claim 1, wherein the additional structure is a patio roof, an eyebrow-type support structure, or an angled handrailing.

15. A structural support apparatus for use in interconnecting an additional structure to an existing building structure, comprising:

a base member including:

a mounting plate configured to be mounted to the existing building structure, and a receiver member having a through hole that defines a pivot point; and an attachment member configured to be pivotably attached to the base member, wherein a first plurality of pivot pin holes are arranged radially around the pivot point of the receiver member, a through hole in a first end of the attachment member defines the pivot point in the attachment member, and a second plurality of pivot pin holes are arranged radially around the pivot point of the attachment member, wherein the first end of the attachment member is pivotably attached to the receiver member via at least one locking pin inserted through one of the first plurality of pivot pin holes formed in the receiver member and one of the second plurality of pivot pin holes formed in the attachment member, a second end of the attachment member is coupled directly or indirectly to the additional structure, and a pivot connecting member configured to attach the attachment member to the receiver member via the pivot point, the pivot connecting member being configured to cover and secure the at least one locking pin.

16. The structural support apparatus of claim 15, wherein the attachment member is pivotable to a plurality of possible angles relative to the base member.

17. The structural support apparatus of claim 15, wherein the attachment member is secured to a structural member via at least one fastener, and the structural member is a roof riser.

18. The structural support apparatus of claim 15, wherein the additional structure is a patio roof, an eyebrow-type support structure, or an angled handrailing.

19. The structural support apparatus of claim 15, wherein a number of the first plurality of pivot pin holes in the receiver member is different from a number of the second plurality of pivot pin holes in the attachment member.

20. The structural support apparatus of claim 15, wherein the second end of the attachment member is coupled indirectly to the additional structure at least in part by:

the attachment member being secured to a structural member via at least one fastener; and the structural member being attached to the additional structure to anchor the additional structure to the existing building structure, and wherein the second end of the attachment member is inserted into one of a slot, hole, opening, and groove formed in the structural member; and the structural member includes left and right lower straddling portions on either side of the one of a slot, hole, opening, and groove, and a plurality of transverse holes pre-drilled through the left and right lower straddling portions.

* * * * *